US009355750B2

(12) United States Patent
Saffman et al.

(10) Patent No.: US 9,355,750 B2
(45) Date of Patent: May 31, 2016

(54) SYSTEM AND METHOD FOR OPTICAL CONFINEMENT OF ATOMIC PARTICLES

(71) Applicant: Wisconsin Alumni Research Foundation, Madison, WI (US)

(72) Inventors: Mark E. Saffman, Madison, WI (US); Martin T. Lichtman, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 14/474,702

(22) Filed: Sep. 2, 2014

(65) Prior Publication Data

US 2016/0064108 A1 Mar. 3, 2016

(51) Int. Cl.
*G21K 5/04* (2006.01)
*G21K 1/00* (2006.01)

(52) U.S. Cl.
CPC ..... *G21K 1/006* (2013.01)

(58) Field of Classification Search
USPC ..... 250/251
See application file for complete search history.

(56) References Cited

U.S. PATENT DOCUMENTS

2007/0284515 A1* 12/2007 Sato ..... G21K 1/006 250/251
2013/0048846 A1* 2/2013 Du ..... G21K 1/006 250/251

OTHER PUBLICATIONS

Piotrowicz et al., A Two Dimensional Lattice of Blue Detuned Atom Traps Using a Projected Gaussian Beam Array, physics.atom-ph, Jul. 2013.

* cited by examiner

*Primary Examiner* — Nicole Ippolito
(74) *Attorney, Agent, or Firm* — Quarles & Brady, LLP

(57) ABSTRACT

A system and method for controlling atomic particles using projected light are provided. In some aspects, a method includes providing a plurality of atomic particles, and generating light fields using frequencies shifted from at least one atomic resonance. The method also includes forming a two-dimensional ("2D") optical array using the generated light fields, wherein the 2D optical array comprises linear segments of light, and projecting the 2D optical array on the plurality of atomic particles to control their respective locations in space.

22 Claims, 11 Drawing Sheets

-PRIOR ART-

SYSTEM AND METHOD FOR OPTICAL CONFINEMENT OF ATOMIC PARTICLES

STATEMENT REGARDING FEDERALLY SPONSORED RESEARCH

This invention was made with government support under W911NF-10-1-0347 awarded by the US Army/ARO. The government has certain rights in the invention.

BACKGROUND

The field of the disclosure is related to systems and methods for controlling small particles. More particularly, the disclosure relates to systems and methods for trapping particles using projected light.

In the field of quantum computation, the performance of quantum bits ("qubits") has advanced rapidly in recent years, with various multi-qubit implementations aiming toward scalable architectures. In contrast to classical computational methods that rely on binary data stored in the form of definite on/off states, or bits, methods in quantum computation take advantage of the quantum mechanical nature of quantum systems, where each qubit can be in a superposition of multiple states. For example, in some applications, qubits can be composed of individual atoms whose quantum states can be controlled and accessed using optical confinement techniques. By manipulating a collection of many qubits, multiple calculations can be performed effectively at the same time, providing enormous computational speed-up capabilities, and impacting areas associated with complex computational problems, such as cryptography, search, simulations, and so on.

Specifically, optical sources can be used to provide periodic or aperiodic potentials, or optical lattices, where particles, such as individual atoms or molecules, can become trapped via the Stark effect. The resulting arrangements of particles, can resemble artificial crystals that are free from defects. Advantageously, these can be utilized to investigate fundamental principles governing interactions and material properties, including quantum phase transitions and quantum spin dynamics, as well as provide promising systems for storing and processing quantum information. Particularly, such systems facilitate the ability to localize and act on an ensemble of identical particles, which can be described by a well-understood quantum structure.

In many applications, neutral atoms have been implemented as promising candidates for quantum information processing due to their well-defined quantum structure and charge neutrality. Particularly, charge neutrality isolates the atoms from charge-related perturbations, and leads to reduced decoherence. In addition, neutral atoms arranged in an optical lattice are unique for quantum information applications, as they afford single particle control, and can be scaled to large qubit systems.

Atomic trapping using optical sources is achieved due to the coherent interactions of applied electromagnetic ("EM") fields and induced oscillating electric dipole moments. Specifically, internal atomic energy shifts occur due to source EM fields, resulting in effective potentials from which confinement forces arise. Generally, optical source wavelengths are shifted, or detuned, with respect to atomic resonances, wherein induced atomic dipole moments within the atom are in-phase for "red" detuning and 180° out-of-phase for "blue" detuning of trapping light field and atomic resonance frequency. Particularly, when a light source frequency is below an atomic transition frequency, or red detuned, respective atoms are attracted to the intensity maxima of the light field created with a strength dependent upon the detuning magnitude, whereas they are repelled from it in the case of blue detuning. Additionally, the potential depth, or strength of attraction, can be modified by controlling the intensity, or power, generated by the optical sources.

Commonly, optical lattices potentials are formed by interference patterns of light fields generated using multiple optical sources. Such patterns, consisting of dark and bright regions in space, are projected onto small particles in order to achieve spatial confinement, where generally, the particles are pre-cooled to temperatures in the microKelvin range. For example, a one-dimensional ("1D") optical lattice can be created by superposing two counter-propagating laser beams such that an optical standing wave is created. Additionally, higher dimensional optical lattices, such as two-("2D") and three-dimensional ("3D") structures, necessitate additional optical sources. For example, as shown in FIG. 1, a simple-cubic lattice structure can be produced by overlapping three orthogonal standing waves formed using 3 pairs of counter-propagating optical sources, while for a 2D optical lattice, the atoms are confined to an array of tightly confining 1D potential tubes using 2 paired sources. In some cases, to generate more complex lattice configurations, the geometry of trapping potentials can be modified by interfering laser beams under different angles.

However, positions of atoms in an optical lattice generated by interference of counter-propagating beams, or beams co-propagating at a small angles, are directly sensitive to optical path-length drifts, causing differential phase shifts between beams. Although such shifts can be, in principle, compensated by using active stabilization techniques, this has, at best, been attempted using single-atom implementations. As such, extending such active stabilization to multi-atom systems adds substantial system complexity.

Given the above, there is a need for systems and methods directed to small particle confinement using optical trapping lattices that are scalable to a large number of sites, minimize crosstalk from neighboring planes of trapped particles, and are stable against position drifts due to optical phase fluctuations.

SUMMARY

The present invention overcomes the aforementioned drawbacks by providing systems and methods for controlling atomic particles using projected light. Specifically, the present disclosure provides a system and method for generating optically-induced traps with increased effectiveness and/or greater efficiency. In some aspects, the projected light fields include linear segments of light arranged on a two-dimensional ("2D") planar grid, which can be used to form optical trap arrays that define locations of atomic particles in three dimensions. This configuration facilitates arrangement of atoms in individual and optically defined sites, which can advantageously find use, for example, in quantum computation applications, such as quantum simulation experiments, as well as atomic clocks, and a variety of atomic sensors.

In one aspect of the present disclosure, a system for controlling atomic particles using projected light is provided. The system includes a particle system including a plurality of atomic particles, and one or more optical sources configured to generate light fields using frequencies shifted from at least one atomic resonance. The system also includes a plurality of optical elements configured to form, using the generated light fields, a two-dimensional ("2D") optical array projected on the plurality of atomic particles, wherein the projected 2D optical array comprises linear segments of light that define locations for the plurality of atomic particles in space.

In another aspect of the present disclosure, a method for controlling atomic particles using projected light is provided. The method includes providing a plurality of atomic particles, and generating light fields using frequencies shifted from at least one atomic resonance. The method also includes forming a two-dimensional ("2D") optical array using the generated light fields, wherein the 2D optical array comprises linear segments of light, and projecting the 2D optical array on the plurality of atomic particles to control their respective locations in space.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DETAILED DESCRIPTION

Figure 1:
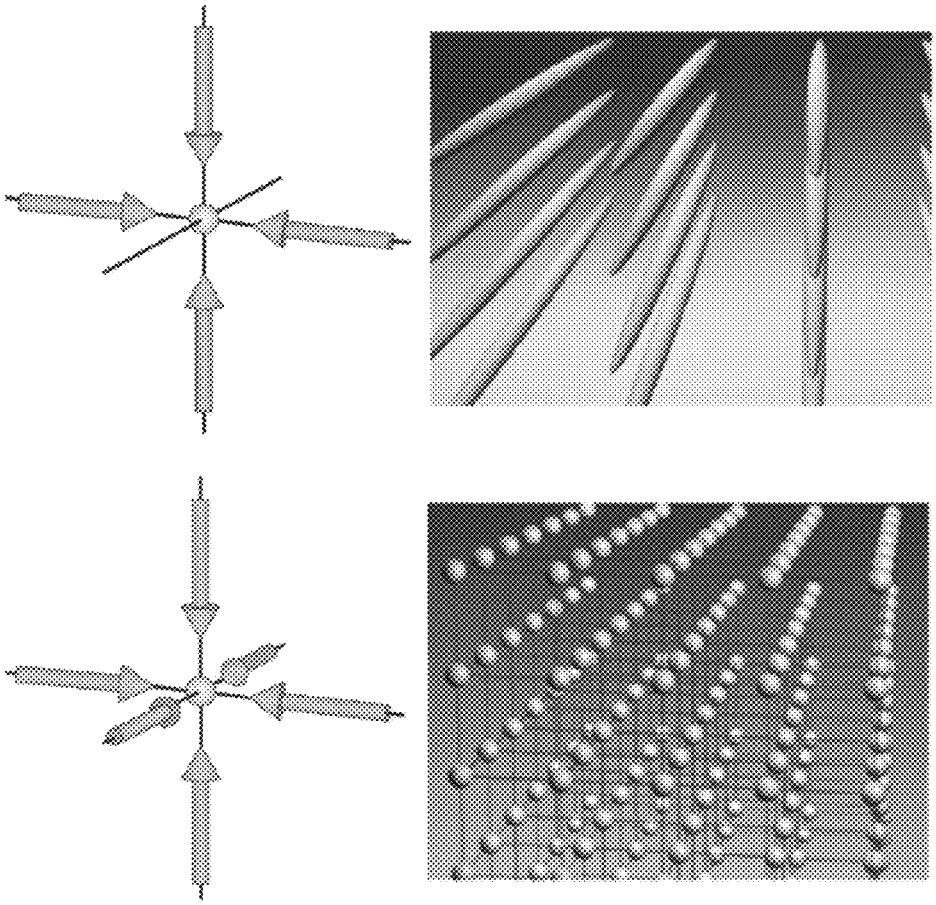
FIG. 1 is a graphical illustration of optical lattice geometries generated using interference of paired counter-propagating optical beams.

The present disclosure provides an approach for controlling multiple particles using projected light fields. Specifically, locations for atomic particles can be confined in three dimensions using multiple light fields arranged on a two-dimensional grid. In particular, optical trap arrays can be formed via a superposition, or combination, of projected light field components, including linear segments of light. In some aspects, such light fields can be configured with different optical frequencies and optical polarizations, such that the different components of light contributing to atom trapping can be effectively incoherent with respect to each other. In this manner, an enhanced optical trap stability can be achieved, as compared to conventional designs, which use optical field interference between mutually coherent light beams.

The absence of interference effects, afforded by the present invention, can yield atomic particle traps that are insensitive to source phase noise. Specifically, unlike previous optical lattice designs, trap positions can remain unaffected by source phase drift, and also would experience no changes in trap depth due to phase noise. In addition, a 2D optical array, in accordance with aspects of the present disclosure, is inherently less sensitive to small misalignments, thus resulting in a more robust device.

Optical arrays generated using linear segments of light, in accordance with aspects of present disclosure, necessitate less optical power to trap each atomic particle, which can increase the number of atoms for a given source input power, and provides deeper traps per input power as compared to previous designs that utilize grids of Gaussian spots. Using light field configurations, as will be described, trap depth can be decoupled from the line width, and therefore traps with better-defined amplitude profiles may be constructed, limited only by the numerical aperture of the optics used. This allows for darker trapping sites with steeper walls, which reduces atomic decoherence effects, and thus affords improved performance of quantum enhanced computers and sensors.

Optical trap arrays configured, in accordance with the present disclosure, have many advantages over previous designs. Specifically, in addition to deeper depths, there is an absence of interference, and hence the traps are insensitive to phase noise and will not change position or depth in response to a source phase drift or noise. Additionally, the present invention provides deeper traps per input laser power compared previous designs. In this manner, either less energy can be consumed for any given number of sites, or more trap sites (i.e. more qubits) can be formed for a given amount of energy. In a non-limiting example, up to 49 trap sites are demonstrated here, which could hold as many as 49 atomic particles. However, it may be appreciated by one skilled in the art that methods of the present invention can be extended or scaled to any number of trapping sites.

Implementations of the present invention can find use in multiple technical fields, including quantum computation. For example, an atomic particle array, configured in accordance with the present disclosure, can be part of a hardware configuration for a quantum computer. Additionally, trapped single atoms can also be used as atomic clocks, atomic sensors, or in quantum simulation experiments.

Figure 2:
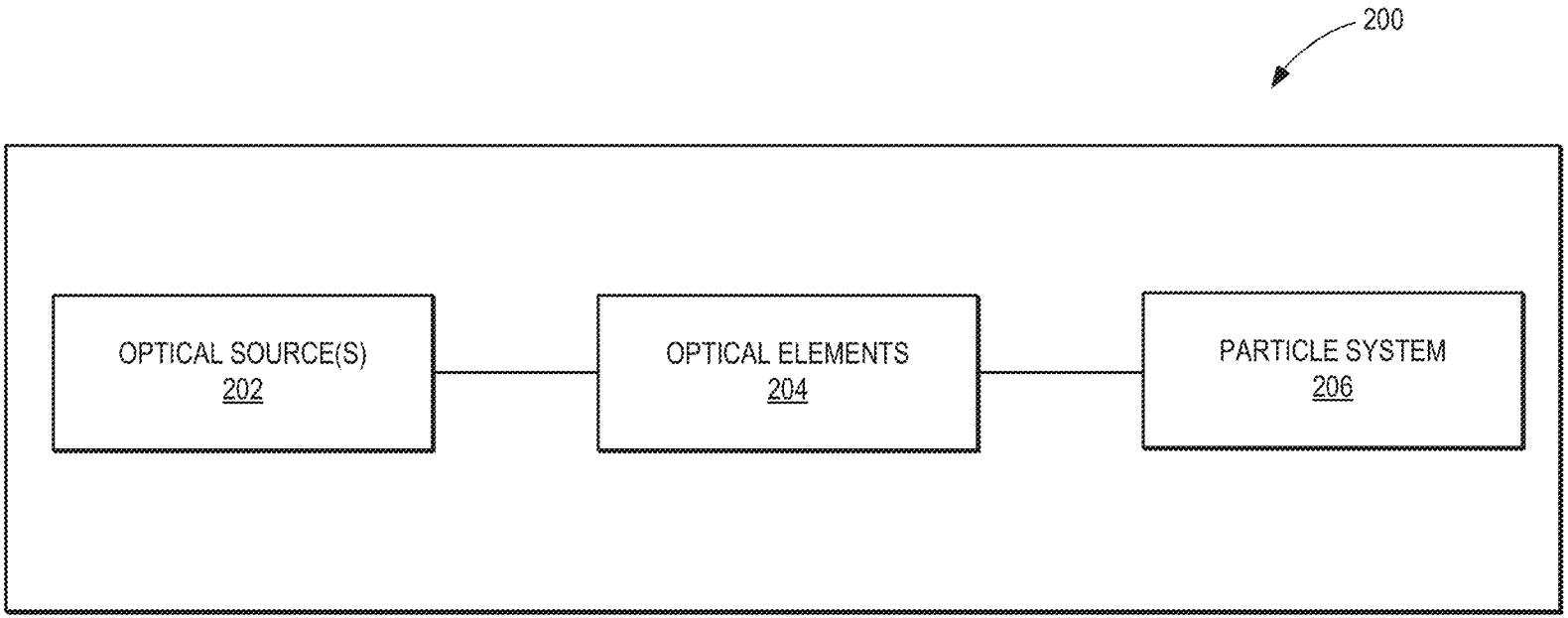
FIG. 2 is a schematic of a trapping system in accordance with the present disclosure.

Turning to FIG. 2, a schematic of an example trapping system 200, for controlling atomic particles using projected light, is provided. The system 200 can include one or more optical sources 202, a plurality of optical elements 204, and a particle system 206.

The one or more optical sources 202 may be configured to generate periodic or aperiodic light fields, using various frequencies, wavelengths, power levels, temporal modulations and so on, and which may overlap in space. Specifically, in some aspects, the optical sources 202 can generate light fields using frequencies shifted from at least one atomic resonance. For example, the light fields can be blue-detuned or red-detuned. The one or more optical sources 202 can include lasers configured with wavelengths in a range between 500 nm and 1500 nm, although other wavelengths are possible. In some configurations, multiple optical sources 202 can be operated at different frequencies, with a frequency separation configured to achieve a target coherence. That is, frequencies may be selected to achieve a full coherence, a partial coherence, or, an incoherence between various light field components. By way of a non-limiting example, two frequencies can be utilized, where the difference in wavelength can be in a range between 0 and 100 nanometers, although other values are possible. In this manner, different components forming particular light fields can be configured to be mutually incoherent.

The plurality of optical elements 204 can include any combination of diffractive, refractive, and polarization sensitive optical elements, and can be configured to direct, transit, modify, focus, divide, modulate, and amplify the generated light fields to various shapes, sizes, profiles, orientations, polarizations, and intensities, as well as any other desirable properties. In accordance with aspects of the present invention, the plurality of optical elements 204 can be configured to form and project a two-dimensional ("2D") optical array, which may include various linear segments of light, and other shapes, onto a collection of atomic particles in order to define or confine their locations in three dimensions. In some aspects, controlling a periodicity of the 2D optical array may be achieved by modifying a magnification of the projecting optical elements 204.

By way of example, in some configurations, diffractive beam splitters or gratings can be utilized to create multiple equal-intensity beams from a single optical source beam. Additionally, beam displacement elements can also be used to reduce a beam spacing, as well as polarize light fields in one or more directions, which may include orthogonal directions. Moreover, various light field components forming a 2D optical array can be either projected simultaneously, sequentially, intermittently or continuously, or any combinations thereof.

The particle system 206 includes a number of atomic particles, as well as any materials and hardware necessary to generate, transfer, manipulate and generally confine the atomic particles. For example, the particle system 206 can include a vacuum system, and capabilities for generating, transferring and confining atomic particles in the vacuum system. By way of example, atomic particles can include any species of neutral atoms. Some non-limiting examples include Rb, Cs, and so on, or combinations thereof. However, systems and methods of the present invention are not limited to alkalis or atomic particles, and can be applied to any particles suitable for optical confinement. In some aspects, the particle system 206 can be configured with capabilities for cooling a collection of atomic particles to any desired temperatures, in order to facilitate trapping. For instance, the atomic particles may be laser cooled to temperatures in a range between 1 and 100 microKelvins, although other values are also possible. Additionally, it may be appreciated that the particle system 206 can include one or more optical elements to facilitate projection of generated light fields onto the atomic particles therein.

In some aspects, the system 200 can optionally include capabilities for controlling or interrogating quantum states of atomic particles configured and arranged in accordance with the present disclosure. Such capabilities facilitate applications including quantum computation, and so forth.

Figure 3:
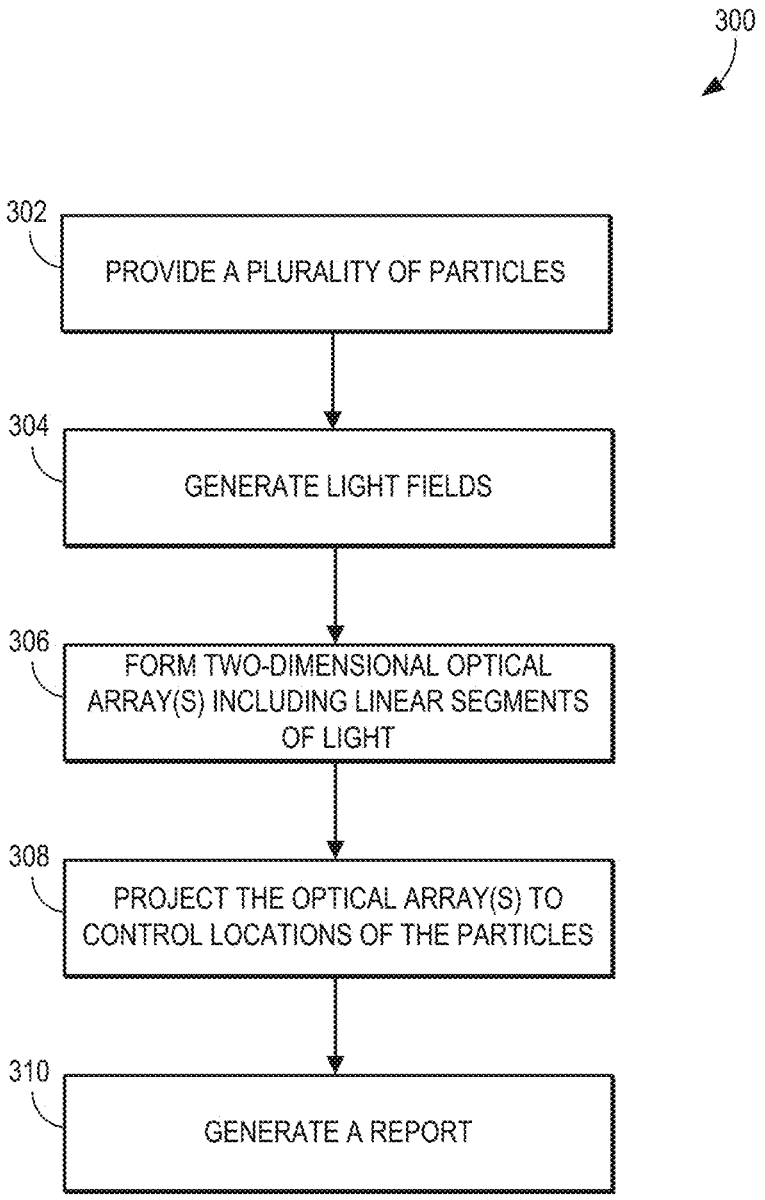
FIG. 3 is a flowchart setting forth steps of one example of a process for particle trapping in accordance with the present disclosure.

Turning now to FIG. 3, steps of a non-limiting example of a process 300 for controlling atomic particles using projected light, in accordance with the present disclosure, are provided. The process may begin at process block 302 where a plurality of atomic particles are provided. For instance, a particle system can be used to prepare the atomic particles, generating and confining a desired number of particles to a particular volume or a general location in space. As described, the provided atomic particles can be cooled at process block 302 to temperatures suitable for optical trapping, for example, using a particle system, as described.

At process block 304, multiple light fields can be generated, using one or more optical sources, for purposes of trapping atomic particles to desired spatial locations in three dimensions. Preferred arrangements includes 2D planar arrays of single particle locations, although other arrangements may be possible. For example, non-rectilinear grids, such as parallelogram, triangular, or hexagonal arrangements, or other geometries may be employed. Also, alternative variations can include multiple particles for each optically-defined location in a 2D planar array. Additionally, systems and methods described herein can be applied to generate multiple 2D planar arrays with various desirable spatial separations, for example, to form multiple interlaced planar arrays, for example, to trap different species and the nodes and anti-nodes of the light.

As described, the light fields generated at process block 304 can be defined using frequencies that are shifted from at least one atomic resonance, and can be blue-detuned or red-detuned, with various values of detuning. Using the generated light fields, at process block 306, a 2D optical array can be formed, to include linear segments of light, as well as other shapes. In some aspects, intersecting linear segments of light, that may overlap, may be arranged to form a square grid. In addition, the linear segments of light may be generally shaped to be elongated, or substantially extending along a first, or longitudinal, direction and constrained along a second, or transverse, direction. Aspect ratios, or ratios of linear segment longitudinal dimensions to transverse dimensions, can be in a range between 15:1 and 2:1, although other values may be possible. In addition, the linear segments of light can also include Gaussian intensity profiles in one or more directions, although other intensity profiles are also possible. Non-limiting examples of values of the lines when projected onto the atomic trapping region are 30 micron long by 1 micron in radius for a 10×10 grid of trapping sites. In addition, linear segments may have periodic intensity to improve the trapping properties of the combined light field.

In some aspects, different linear segments may be configured to be mutually incoherent, by way of multiple frequencies and polarizations of light fields therein, in order to enhance trap stability and eliminate undesirable effects due to source phase noise. As described, this can be achieved using any number of optical elements. At process block 308, the 2D optical array can then be projected on a plurality of atomic particles to control their respective locations in space. In some configurations, the creation of a 2D array of trapping sites, which are each well localized in 3D, can be achieved by projection of the light through a single lens or planar optical window.

In some aspects, a report may be generated at process block 310, which can be of any shape or form. For example, the report may be formed by way of readout light, or fluorescence images may be acquired to identify trap loading rates. Additionally, information related to the state of one or more atomic particles trapped in a 2D optical trap array can be provided using various interrogation techniques.

Figure 4C:
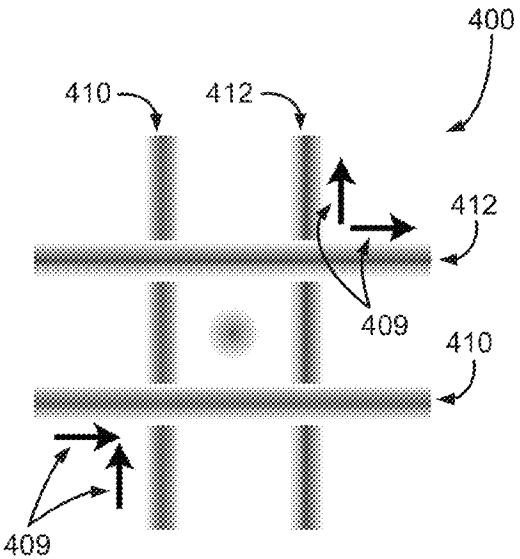
FIGS. 4*a*-4*c* are schematic illustrations of geometries of example coherent, partially coherent, and incoherent trap arrays, respectively, formed using projected grid lines in accordance with the present disclosure.
Figure 4B:
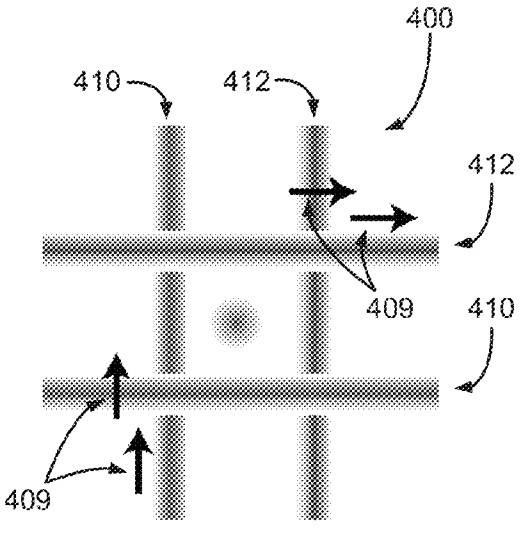
Figure 4A:
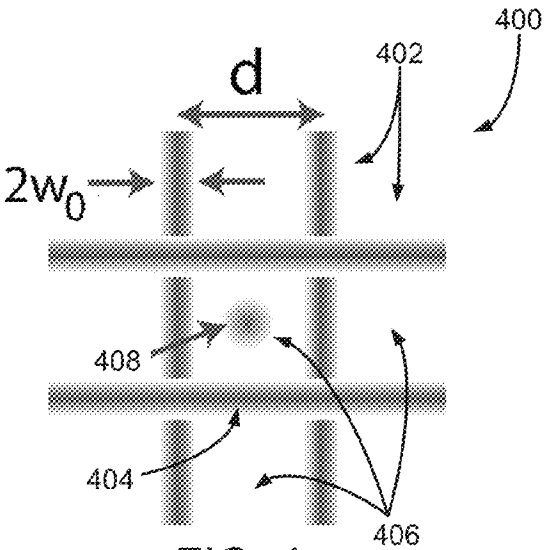

By way of example, example trap configurations, in accordance with aspects of the present disclosure, are shown in FIGS. 4*a*-4*c*. Specifically, each configuration shown depicts a 2D array, including multiple unit cells 400, and forming a planar square grid, using transversely intersecting lines, or linear segments of light, generally, 402, although other grid configurations may be possible. In some aspects, intensity profiles of intersecting lines may be configured such that saddle points 404 are higher in intensity, thus giving better trap depth. Planar locations 406 for the particles 408 are defined at the center of the cell 400, while z confinement, or out of plane trapping, can be provided by diffraction, as will be described.

While, as illustrated in FIG. 4*a*, coherent forms may be used, consideration may advantageously be given to the Talbot effect due to multiple trapping planes. This may be suppressed using combinations of partially incoherent (FIG. 4*b*) or mutually incoherent fields (FIG. 4*c*). In FIGS. 4*b* and 4*c*, the arrows 409 indicate polarization. For example, as shown in FIG. 4*b*, a first set of lines or segments of light 410, each with the same first polarization, can be described by a first frequency (e.g., blue), while a second set of lines or segments of light 412, each with the same second polarization, can be described by a second frequency (e.g., red), wherein the first and second polarization are different, and the first and second frequencies are separated by a desirable a frequency separation. Alternatively, fully incoherent fields, as shown in FIG. 4*c*, include lines in the first set of lines or segments of light 410, described by a first frequency (e.g., blue), that can have different respective polarizations. Similarly, lines in the second set of lines or segments of light 412, are described by a second frequency (e.g., red), and also have different respective polarization. Advantageously, the use of such incoherent fields also removes phase dependence of the intensity structure at the trap center.

Although illustrations shown in FIGS. 4*a*-4*c* depict 2D optical arrays formed using linear segments of light, it may be appreciated that other arrays, in accordance with aspects of the present disclosure, may also include light fields described by various shapes, including dots, ellipses, squares, rectangles and so forth, and any combinations thereof, arranged along various orientations, and including various intensity profiles and dimensions. For example, line segments may be designed to have or approach 100 percent efficiency for using available optical power, such that corners of a trap are formed by the intersection of four lines segments that respectively account for 25 percent. This can be achieved using, for example, a periodic intensity along the lines. More particularly, referring to FIG. 8*c*, a Gaussian line array is illustrated, where the intensity profile along the lines is Gaussian, which is achievable and has desirable diffraction properties. To make the array approach 100 percent efficiency, the profile along the line is designed to complement of the transverse intensity profile. For example, line segments may have a flat top with linear ramps near the intersections or corners of the trap, but have a transverse profile that is a linear ramp.

The details of the trap depth and confinement depend on whether or not the linear segments 402 forming each unit cell 400 are all incoherent with respect to each other. Specifically, different configurations for each linear segment of light forming a unit cell may result in a fully coherent, fully incoherent, or something in between. These cases are analyzed below.

Assume each line is a 1D Gaussian beam $I_P=I_0e^{-2\rho^2/\omega_0^2}$ with $I_0$ being the peak intensity, ρ the perpendicular coordinate and uniform intensity along the beam axis. Such "flat-top" Gaussian beams can be created using diffractive or refractive optical elements. The power per unit length of the 1D Gaussian is $P_{\|}=\sqrt{\pi/2}\omega_0 I_0$. In the limit of an infinite array, there are two sides, giving a length of 2d per unit cell, and the power per trapping being $$P = 2dP_{\|} = \sqrt{2}\,\pi d\omega_0 I_0 \text{ or } I_0 = \frac{P}{\sqrt{2}\,\pi d\omega_0}.$$

It may be useful to introduce the aspect ratio parameter, namely $s=d/\omega_0$, in terms of which:

$$P_{\|} = \sqrt{\frac{\pi}{2}}\,\frac{d}{s} I_0, \quad P = \frac{\sqrt{2\pi}\,d^2}{s} I_0, \quad I_0 = \frac{s}{\sqrt{2\pi}\,d^2} P. \tag{1.1}$$

Fully Incoherent

Assuming the 4 sides of a unit cell, as described, are mutually incoherent using frequency and polarization degrees of freedom, the intensity at a saddle position is $I_s=I_0(1+2e^{-s^2/2})$.

The intensity at trap center is $I_c=4I_0e^{-s^2/2}$ and the trapping intensity in the transverse plane is:

$$I_{t,xy} = I_s - I_c = I_0\left(1 - 2e^{s^2/2}\right) = I_d \times \frac{s}{\sqrt{2\pi}}\left(1 - 2e^{s^2/2}\right); \tag{1.2}$$

with $$I_d = \frac{P}{d^2} = \sqrt{2\pi}\, I_0/s.$$

The trapping intensity increases approximately linearly with s.

The intensity at trap center a distance z perpendicular to the trapping plane is $$I_c(z) = 4\frac{I_0}{\sqrt{1+\frac{z^2}{z_R^2}}} e^{-\frac{s^2}{2}\frac{1}{1+\frac{z^2}{z_R^2}}}.$$

Here it is assumed that the lines have a constant parallel intensity over a sufficiently long length that the parallel diffractive spreading can be neglected. The out of plane trapping intensity is:

$$I_c(z) = I_c(z) - I_c(0) = 4I_0\left(\frac{e^{-\frac{s^2}{2}\frac{1}{1+\frac{z^2}{z_R^2}}}}{\sqrt{1+\frac{z^2}{z_R^2}}} - e^{-s^2/2}\right) = I_d \times \frac{4s}{\sqrt{2}\,\pi}\left(\frac{e^{-\frac{s^2}{2}\frac{1}{1+\frac{z^2}{z_R^2}}}}{\sqrt{1+\frac{z^2}{z_R^2}}} - e^{-s^2/2}\right), \tag{1.3}$$

with $z_R=\pi\omega_0^2/\lambda=\pi d^2/(s^2\lambda)$ and λ the trapping light wavelength. This has a maximum at $z_{max}=z_R\sqrt{s^2-1}$, where:

$$I_{t,z}(z_{max}) = I_d \times \frac{4}{\sqrt{2\pi}}\left(\frac{1}{\sqrt{e}} - se^{-s^2/2}\right). \tag{1.4}$$

As s→∞, the trapping intensity asymptotes to $$I_{t,z}(z_{max}) = I_d \times \frac{4}{\sqrt{2\pi e}}.$$

Figure 5A:
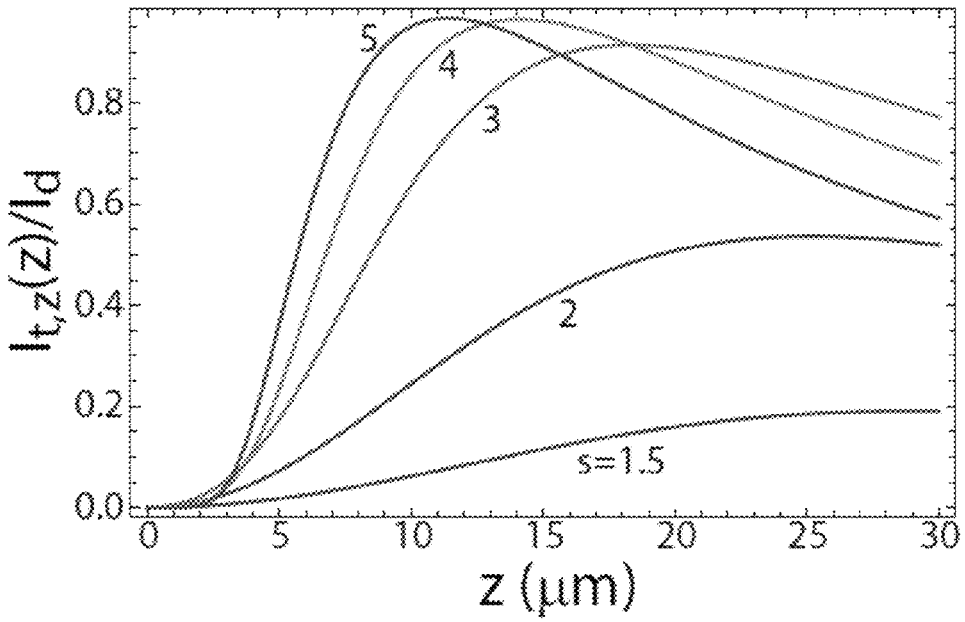
FIGS. 5*a* and 5*b* are graphs providing a graphical illustration of trapping intensities for different beam parameters.
Figure 5B:
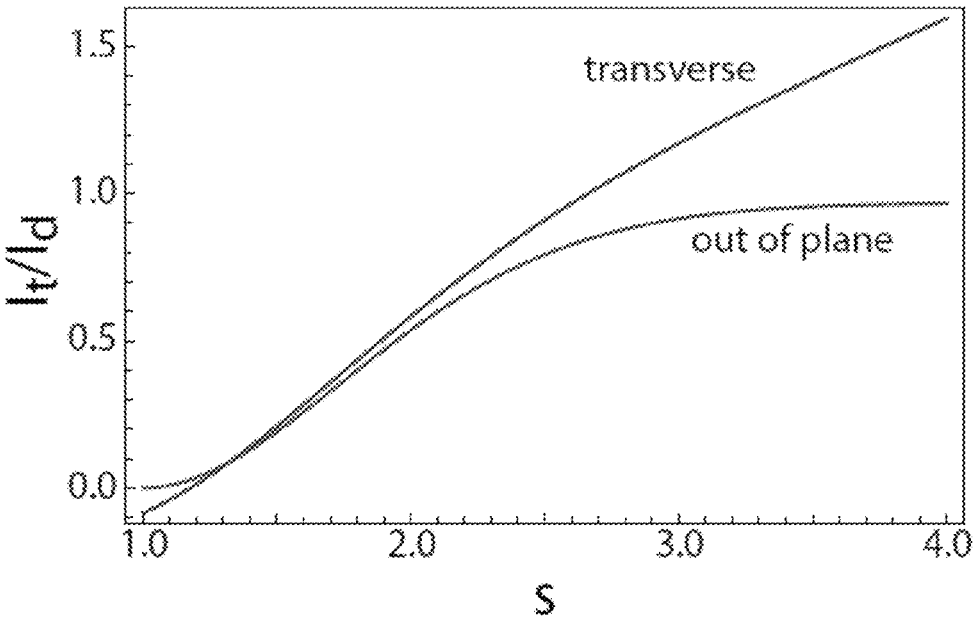

The trapping intensity for different beam parameters shown in FIGS. 5*a* and 5*b*. FIG. 5*a* shows $I_{t,z}(z)$ versus the out of plane coordinate z for d=3.8 μm, λ=0.78 μm and several values of s. FIG. 5*b* shows the transverse and out of plane trapping intensities versus s. The curves are normalized to $I_d=P/d^2$. It is seen that for small s the out of plane trap depth is largest and for large s the transverse trap depth is largest. The 3D trap depth is given by (1.4) for s>1.32 where (1.2) and (1.4) cross over. The trapping potential for $$s > 1.32 \text{ is } U_t = -\frac{\alpha}{2\varepsilon_0 c} I_t = U_d \frac{4}{\sqrt{2\pi}}\left(\frac{1}{\sqrt{e}} - s e^{-s^2/2}\right)$$

with $$U_d = -\frac{\alpha I_d}{2\varepsilon_0 c}$$

and α the atomic polarizability. Since $I_d=P/d^2$ it may be recognized that $U_d$ is the characteristic optical potential per unit cell.

The atomic localization is found from the trap curvature at the origin. An atomic particle at position r=(x,y,z) relative to the origin of a unit cell sees an optical potential:

$$\begin{aligned} U(r) &= -\frac{\alpha}{2\varepsilon_0 c} I(r) \\ &= U_d \frac{s}{\sqrt{2\pi(1+z^2/z_R^2)}} \\ &\left[e^{\frac{2s^2(d/2-x)^2}{d^2(1+z^2/z_R^2)}} + e^{\frac{2s^2(d/2+x)^2}{d^2(1+z^2/z_R^2)}} + e^{\frac{2s^2(d/2-y)^2}{d^2(1+z^2/z_R^2)}} + e^{\frac{2s^2(d/2+y)^2}{d^2(1+z^2/z_R^2)}}\right] \end{aligned}$$

Expanding about the origin it may be found that:

$$U(r) \simeq U(0) + \frac{U_d}{d^2}\sqrt{8/\pi s^3}\,(s^2-1)e^{-s^2/2}(x^2+y^2) + \frac{U_d}{d^2}\frac{\lambda^2}{d^2}\sqrt{2/\pi^5}\,\lambda^2 s^5(s^2-1)e^{-s^2/2} + \ldots$$

The spring constants are therefore:

$$\kappa_x = \kappa_y = \frac{U_d}{d^2}\sqrt{32/\pi}\,s^3(s^2-1)e^{-s^2/2}$$

$$\kappa_z = \frac{U_d}{d^2}\frac{\lambda^2}{d^2}\sqrt{8/\pi^5}\,s^5(s^2-1)e^{-s^2/2}.$$

The spring constant for motion in any direction in the x-y plane is equal to $K_x$. The spring constants are maximal for $$s = \sqrt{3+\sqrt{6}} = 2.33$$

for x motion, and $$s = \sqrt{4+\sqrt{11}} = 2.70$$

for z motion. The oscillation frequencies are given by $\omega=\sqrt{\kappa/m}$ with m the atomic mass. The time-averaged position variances $\sigma_j^2$ are found from $$\frac{1}{2}\kappa_j\sigma_j^2 = \frac{1}{2}\kappa_j\langle r_j^2\rangle = \frac{1}{2}k_B T$$

where T is the atomic temperature. They are:

$$\sigma_x^2 = \sigma_{x0}^2\frac{e^{s^2/2}}{s^3(s^2-1)},\ \sigma_{x0}^2 = \frac{d^2 k_B T}{\sqrt{32/\pi}\,|U_d|}$$

$$\sigma_z^2 = \sigma_{z0}^2\frac{e^{s^2/2}}{s^5(s^2-1)},\ \sigma_{z0}^2 = \frac{d^4 k_B T}{\sqrt{8/\pi^5}\,\lambda^2|U_d|}$$

Figure 6A:
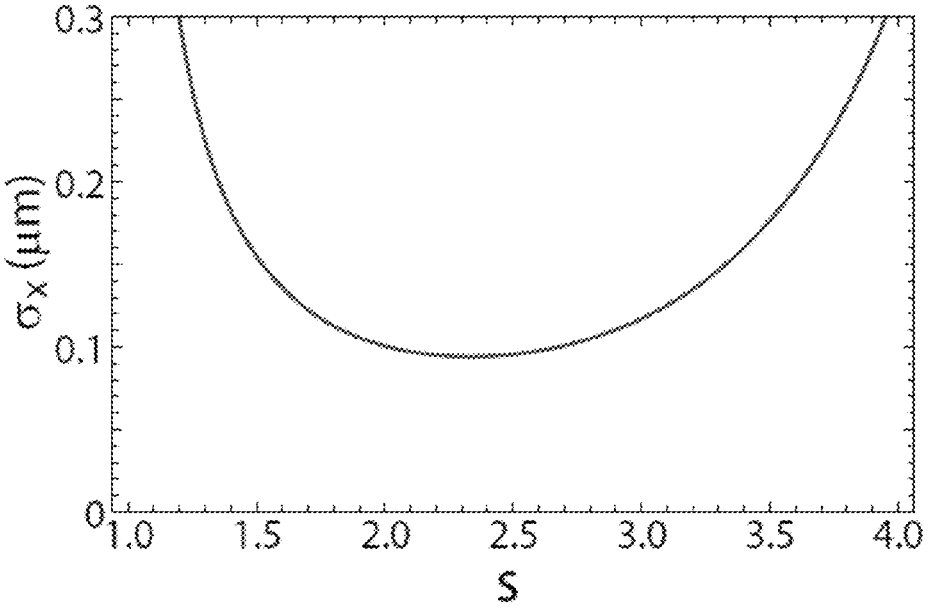
FIGS. 6*a* and 6*b* are graphs providing a graphical illustration of localization lengths for nominal experimental parameters.
Figure 6B:
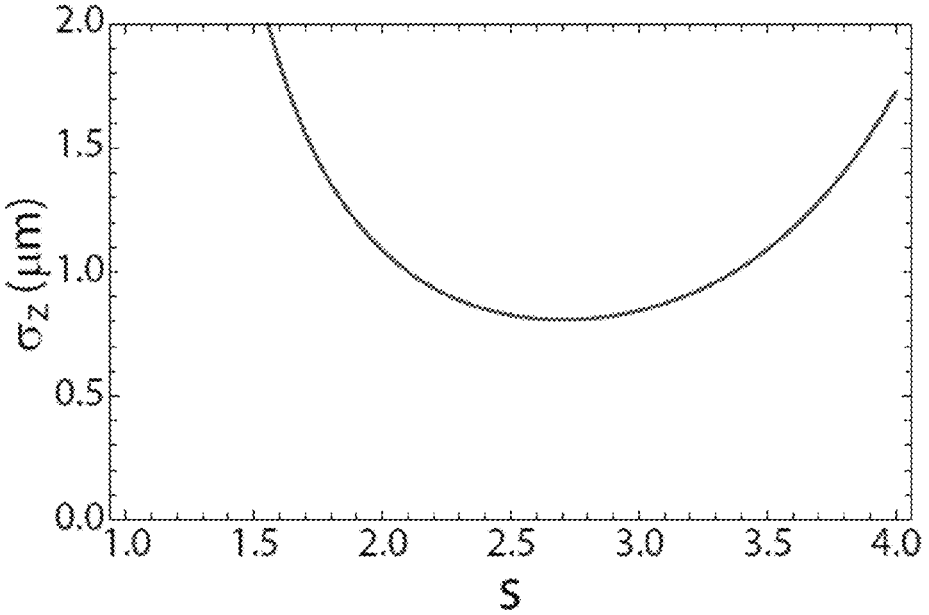

Plots of the localization lengths $\sigma_x$, $\sigma_z$ are shown in FIGS. 6*a* and 6*b* using nominal experimental parameters.

To further illustrate advantages of the present invention, a comparison can be made for the trap depth of the line array ("LA"), in accordance with aspects described herein, and a previously described in M. J. Piotrowicz, "Two-dimensional lattice of blue-detuned atom traps using a projected Gaussian beam array." Phys. Rev. A 88, 013420 (2013), which is incorporated herein by reference, Gaussian beam array ("GBA") design. The GBA has a trap depth $$U_{t,GBA} = U_d\frac{4s^2 e^{-s^2/2}}{\pi}\left(1-2e^{s^2/2}\right).$$

This reaches a maximum of $U_{t,GBA}/U_d=0.51$ at s=1.92. The LA design reaches a maximum of $U_t/U_d=0.97$ as s→∞ so the LA design is more efficient in optical power usage by a factor of 0.97/0.51=1.9. It should be mentioned that the LA has reduced atomic localization as s→∞, as can be seen in FIGS. 6*a* and 6*b*. If s=3, which provides a close to optimal localization, then the LA design has $U_t/U_d=0.91$ and $U_t/U_{t,GBA}=1.8$.

Finite Size Arrays

Figure 7:
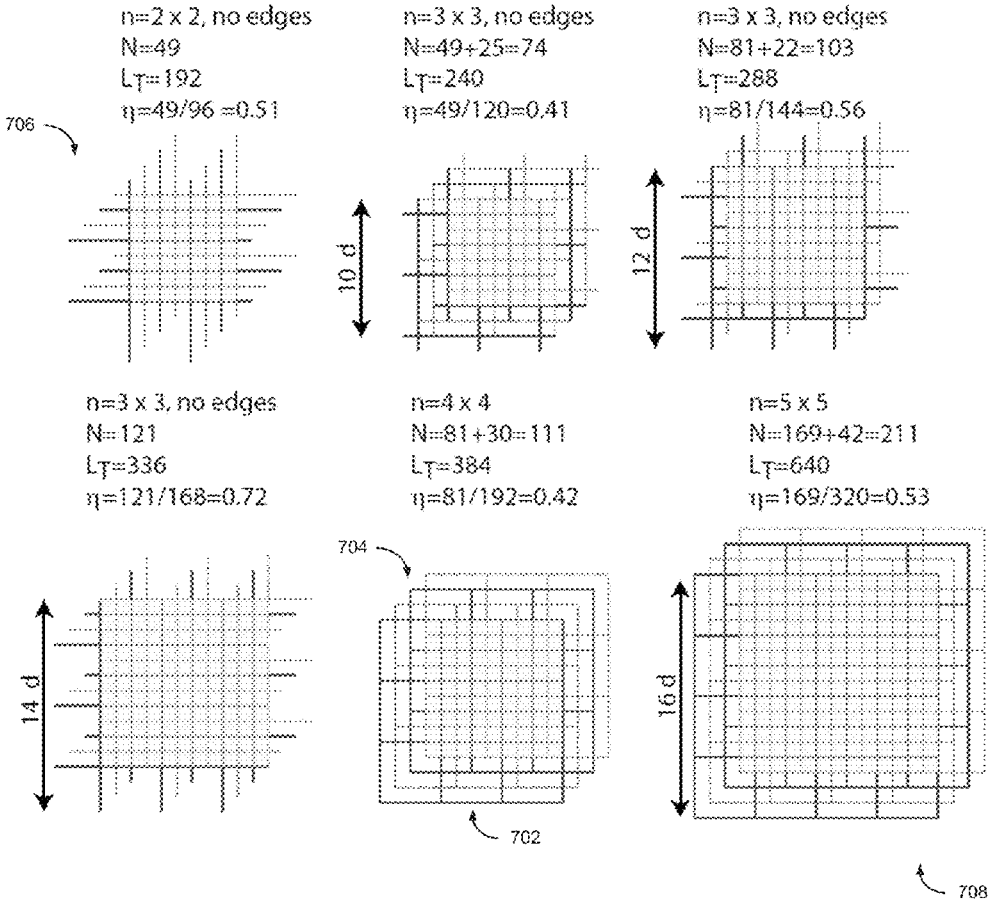
FIG. 7 is a graphical illustration of multiple example line array trap layouts, in accordance with the present disclosure.

Some example implementations of finite sized array layouts are shown in FIG. 7. Specifically, such layouts can include multiple unit cells, defined using different frequencies of light, for instance, a first 702 and second frequency 704. In some configurations, optical arrays can include incomplete, or no, edges 706 and as well as completed edges 708.

For a single unit cell the relation between power and peak intensity is given by (1.1). For finite sized arrays there is wasted power at the ends of the line segments. To account for this, an efficiency factor η is defined as the ratio of the number of trapping sites N, divided by $L_T/2$, the total length of lines forming the trap array in units of 2d. Ideally for an infinite size array η approaches 1.

Factors of P in expressions, as described above, for the trapping intensity may then be replaced by $$\frac{\eta P_{array}}{N},$$

where $P_{array}$ is the total optical power for the array and N is the number of trapping sites. The trapping intensity for s>1.32 is then:

$$I_t = \frac{\eta P_{array}}{d^2 N} \times \frac{4}{\sqrt{2\pi}}\left(\frac{1}{\sqrt{e}} - se^{-s^2/2}\right); \tag{1.5}$$

and the trap depth is $$U_{t,LA} = -\frac{\alpha}{\sqrt{2\pi\epsilon_0 c}} I_t = -\frac{\alpha}{\sqrt{2\pi\epsilon_0 c}} \frac{\eta P_{array}}{d^2 N} 4\left(\frac{1}{\sqrt{e}} - se^{-s^2/2}\right).$$

Figures 8A, 8B, 8C:
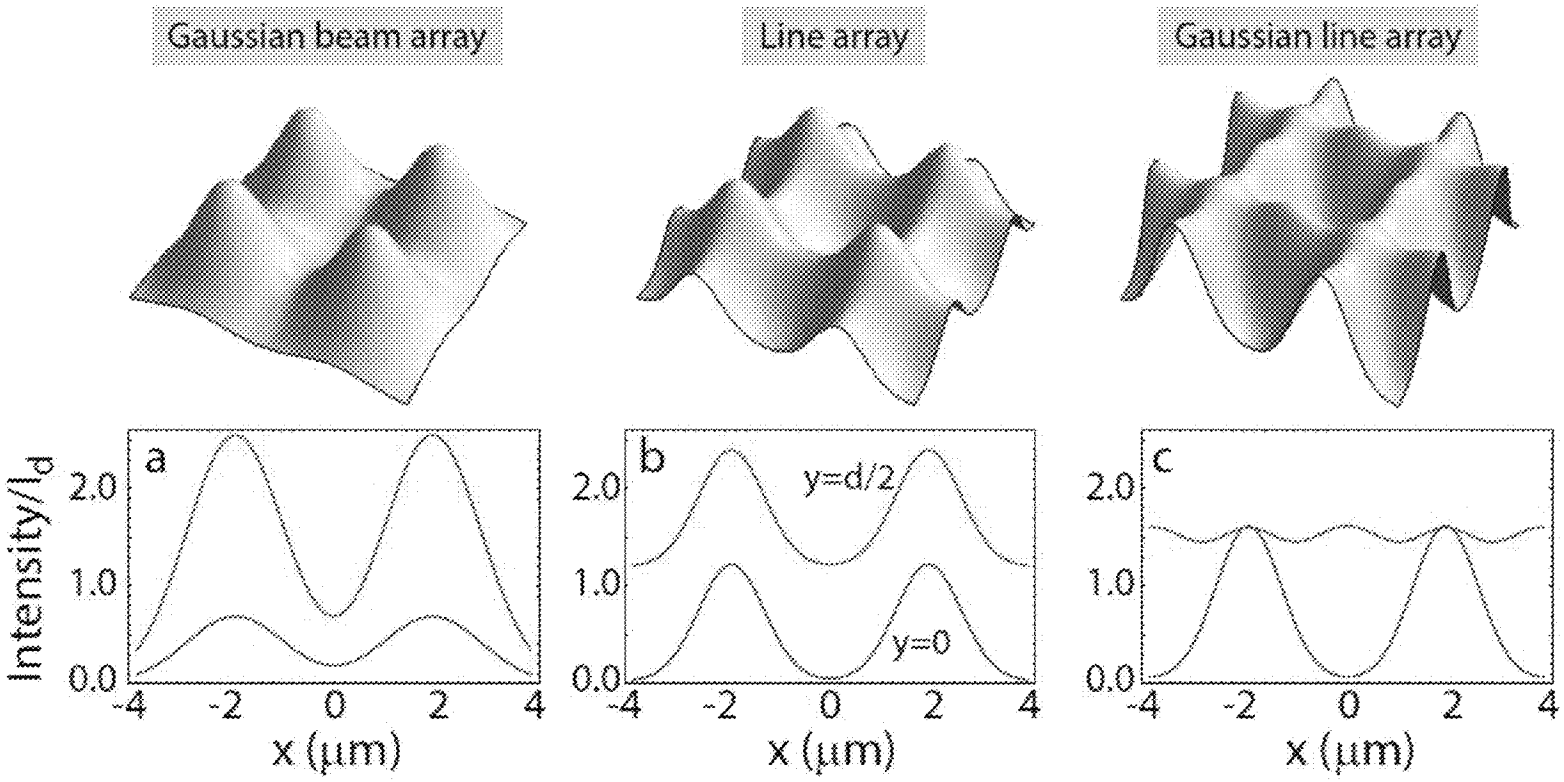
FIGS. 8*a*-8*c* are graphical illustrations comparing intensity profiles between an example Gaussian beam array, a line array, and a Gaussian line array, respectively, in accordance with aspects of the present disclosure.

For example, in the case of Cs atoms confined with a 780 nm wavelength trap, $\alpha_{cgs}=-252.10\times10^{-24}$ cm$^3$ and $\alpha=\alpha_{SI}=10^{-6}\times4\pi\epsilon_0\alpha_{cgs}$. For comparison purposes, one may use d=3.8 μm, $\omega_0$=1.3 μm, s=2.92. and $P_{array}$=0.5×5 W (2.5 W at each frequency with 50% efficiency in projection onto atoms). Then, the following trap depths are found:

$N = 49, \quad \eta = 0.52, \quad 0.63$ mk $N = 49 + 25, \quad \eta = 0.40, \quad 0.49$ mK $N = 81 + 22, \quad \eta = 0.56, \quad 0.41$ mK $N = 121, \quad \eta = 0.72, \quad 0.36$ mk Gaussian Line Array The efficiency of the GBA is less than optimal because the high optical intensity at the corners of each unit cell is wasted. This is seen in the intensity contour map in FIG. 8*a*. The LA design described improves on this but still has an intensity at the unit cell corners which is approximately two times higher than the intensity at the middle of each side, as shown in FIG. 8*b*. Hence, available optical power can be used more efficiently by using linear segments of light with non-uniform profiles such that the intensity is close to uniform all the way around each unit cell.

Specifically, a uniform intensity condition can be approximated using elliptical Gaussian beams, as shown in FIG. 8*c*. This design is referred to as a Gaussian line array ("GLA"). Let each side of a unit cell be defined by a Gaussian beam propagating along z as before but with a transverse intensity profile:

$$I(r_{\|},r_{\perp})=I_0 e^{-2r_{\|}^2/\omega_{\|}^2} e^{-2r_{\perp}^2/\omega_{\perp}^2}.$$

Figure 9C:
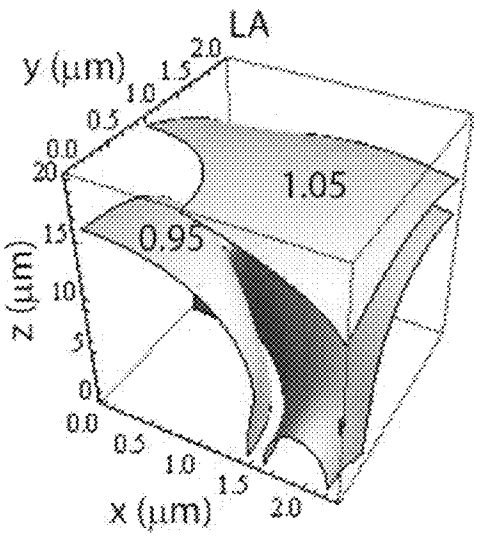
FIGS. 9*a*-9*c* are graphical illustrations depicting contours of constant trap potentials for an example Gaussian line array, Gaussian beam array, line array, respectively.
Figure 9B:
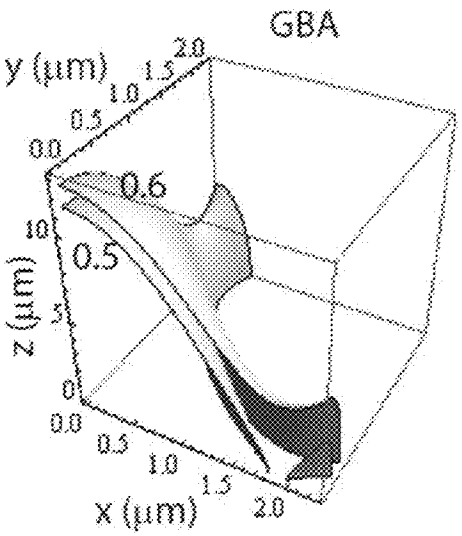
Figure 9A:
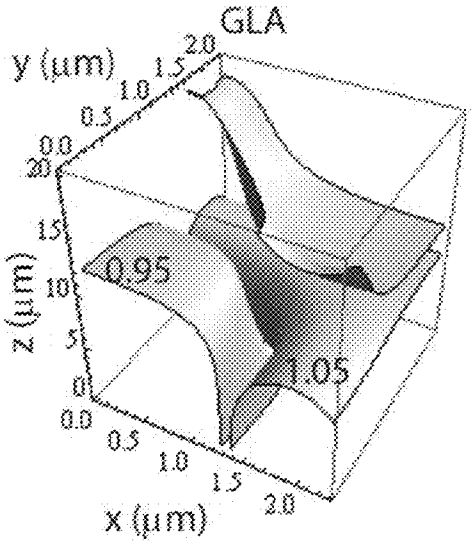

Here $r_{\|}/r_{\perp}$ are coordinates along/perpendicular to each line segment and one can introduce $s_{\|}=d/\omega_{\|}, s_{\perp}=d/\omega_{\perp}$. For a fully incoherent arrangement the intensity at a unit cell corner is approximately:

$$I_{corner}=4I_0 e^{-s_{\|}^2/2}$$

while the intensity in the middle of the unit cell side is:

$$I_{side}=I_0[1+(2\pm2)e^{-2s_{\|}^2}]$$

where it is assumed that $s_{\|}<<s_{\perp}$. The ± signs above corresponds to the fields from neighboring unit cells, which are mutually coherent, adding constructively. Setting $I_{corner}=I_{side}$ with 2±2 replaced by the average value of 2 gives $s_{\|}$=1.66. This value of $s_{\|}$ changes by less than one percent irrespective of the sign of the field interference which provides only a small correction to the intensity profile. FIGS. 9*a*, 9*b*, and 9*c* show the light intensity contours in 3 dimensions using this condition, as well as those for the GBA and LA designs, respectively.

In the following analysis of an example GLA design let $s_{\|}$=1.66, take the average of field interference from neighboring cells (e.g. replace 2±2 by 2), and vary $s_{\perp}$ to find optimal trap parameters. The power unit cell in an extended array is simply the power of two sides or $$P = 2\frac{\pi\omega_{\|}\omega_{\perp}}{2} I_0$$

with $I_0$ being the peak intensity of the elliptical Gaussian beam. This relation can be written as:

$$I_0 = \frac{P}{\pi\omega_{\|}\omega_{\perp}} = \frac{P}{d^2}\frac{s_{\|}s_{\perp}}{\pi} = I_d\frac{s_{\|}s_{\perp}}{\pi}.$$

The intensity at trap center is:

$$I_c = 4I_0 e^{-s_{\perp}^2/2} = I_d \times \frac{4s_{\|}s_{\perp}}{\pi} e^{-s_{\perp}^2/2}.$$

The transverse trapping intensity is thus:

$$I_{t,xy} = I_0 - I_c = I_d \times \frac{s_{\|}s_{\perp}}{\pi}\left(1 - 4e^{-s_{\perp}^2/2}\right).$$

and the transverse trap depth is:

$$U_{t,xy} = U_d \times \frac{s_{\|}s_{\perp}}{\pi}\left(1 - 4e^{-s_{\perp}^2/2}\right).$$

Taking $s_{\|}$=1.66, $s_{\perp}$=3.0, one obtains $U_{t,xy}=U_d$=1.51, which is about 66% better than the value of 0.91 found for the LA design described above. However, the out of plane trapping potential is similar to that found for the LA design so there is no appreciable improvement in trap depth. This can be seen from the 3D potential contours in FIG. 9.

Finally consideration is given to the localization properties of the GLA design. Specifically, the GLA design is advantageous with respect to atomic localization, as it may be numerically found that for $s_{\|}$=1.66 the best in plane localization is at $s_{\perp}$=2.42 and $\kappa_x$=0.99.

The intensity at trap center a distance z perpendicular to the trapping plane is:

$$I_c(z) = 4I_0 \frac{e^{-\frac{s_{\perp}^2}{2}\frac{1}{1+\frac{z^2}{z_{R\perp}^2}}}}{\sqrt{1+\frac{z^2}{z_{R\|}^2}}\sqrt{1+\frac{z^2}{z_{R\perp}^2}}};$$

with $z_{R\parallel}=\pi d^2/(s_\parallel{}^2\lambda)$, $z_{R\perp}=\pi d^2/(s_\perp{}^2\lambda)$. The out of plane trapping intensity is:

$$I_{t,z}(z) = I_c(z) - I_c(0) = I_d \times \frac{4s_\parallel s_\perp}{\pi}\left(\frac{e^{-\frac{s_\perp^2}{2}\frac{1}{1+\frac{z^2}{z_{R\perp}^2}}}}{\sqrt{1+\frac{z^2}{z_{R\parallel}^2}}\sqrt{1+\frac{z^2}{z_{R\perp}^2}}} - e^{-s_\perp^2/2}\right).$$

Figure 10A:
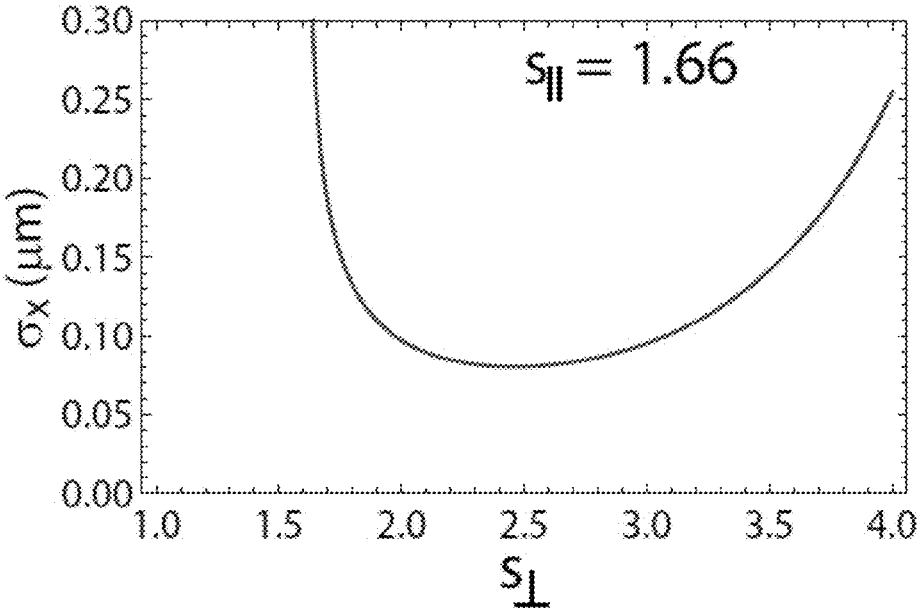
FIGS. 10*a* and 10*b* are graphs providing a graphical illustration of localization lengths for a Gaussian line array, in accordance with aspects of the present disclosure.
Figure 10B:
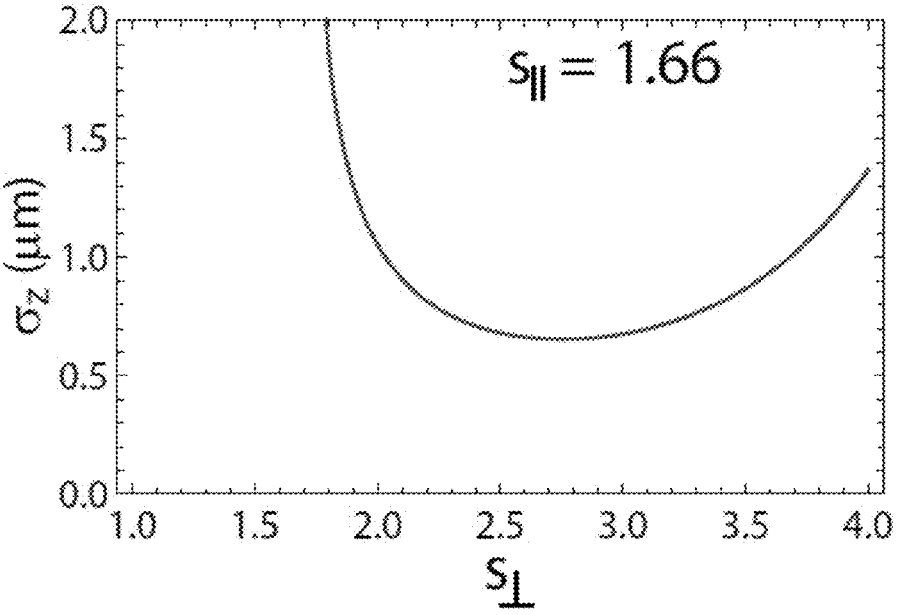

This has a maximum at a value of z which can be found analytically, but results in an unwieldy formula. FIGS. 10*a* and 10*b* show the atom localization found numerically. The localization is comparable to that found from the LA design.

Optical Design

As described, the LA and GLA designs can be implemented using any combination of diffractive and refractive optical elements. LA implementations, as shown in FIG. 7, have a slight disadvantage that some light is less efficiently utilized at the edges of the array where no traps are formed. Hence, herein it is shown that an implementation using a GLA design has controlled wasted light.

Figure 11:
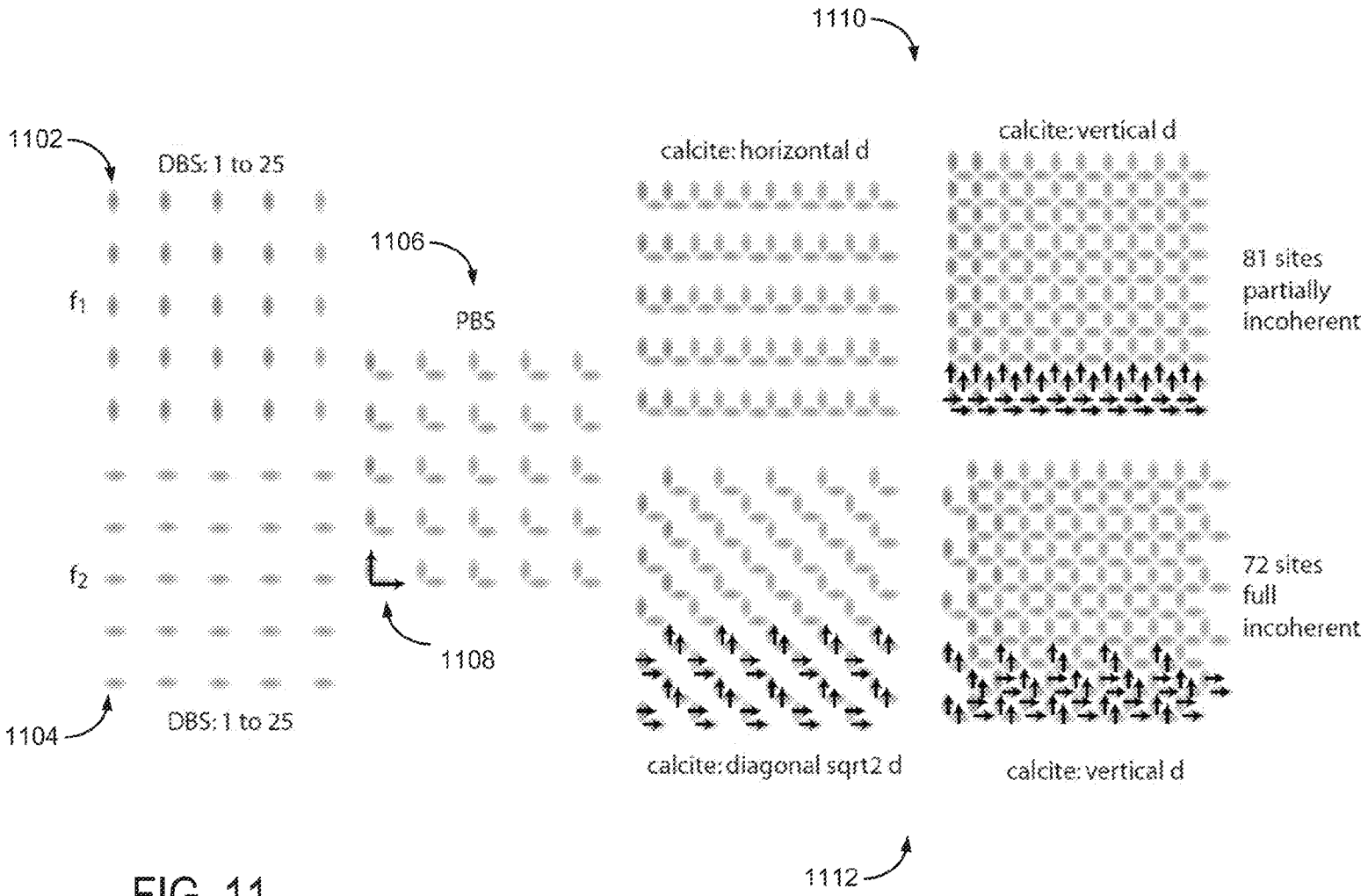
FIG. 11 is a graphical illustration depicting example Gaussian line arrays in accordance with the present disclosure.

Example optical transformations desirable for implementing a GLA design using single Gaussian beams, are shown in FIG. 11. Specifically, starting at the left, input beams, described by a first frequency 1102, f1, and second frequency 1104, f2, can be copied to 25 spots each using diffractive beam splitters ("DBS"). Each spot may be an elliptical beam with a given aspect ratio, although other shapes are also possible, which can be formed by providing an eliptical input beam to the DBS. The two optical beam arrays can then be losslessly combined using a polarizing beam splitter ("PBS") 1106, providing a desirable polarization, as indicated by arrows 1108, to optical fields therein. FIG. 11 then shows two possible alternative designs. Specifically, in the top row 1110, calcite displacements of d horizontally and d vertically can create 81 sites, each of which is effectively partially incoherent. In the bottom row 1112, calcite displacements of √d diagonally and d vertically can create 72 fully incoherent sites. The two examples shown create 81 or 72 sites with efficiency $\eta$=0.81, and 0.72, respectively.

The present invention has been described in terms of one or more preferred embodiments, and it should be appreciated that many equivalents, alternatives, variations, and modifications, aside from those expressly stated, are possible and within the scope of the invention.

The invention claimed is:

1. A method for controlling atomic particles using projected light comprising:

a) providing a plurality of atomic particles;

b) generating light fields using frequencies shifted from at least one atomic resonance;

c) forming a two-dimensional ("2D") optical array using the generated light fields, wherein the 2D optical array comprises linear segments of light; and d) projecting the 2D optical array on the plurality of atomic particles to control their respective locations in space.

2. The method of claim 1, wherein step a) comprises preparing the plurality of atomic particles using a particle system.

3. The method of claim 1, wherein step a) further comprises cooling the plurality of atomic particles to temperatures in a range between 1 and 100 micro Kelvin.

4. The method of claim 1, wherein the frequencies are selected to achieve at least one of a blue detuning or a red detuning.

5. The method of claim 1, wherein the frequencies include at least a first frequency and a second frequency that is distinct from the first frequency.

6. The method of claim 5, wherein the at least first frequency and second frequency are separated by a frequency separation configured to achieve a target coherence.

7. The method of claim 1, wherein step c) further comprises polarizing the light fields in one or more directions.

8. The method of claim 1, wherein step c) further comprises controlling a periodicity of the 2D optical array by modifying a magnification of projecting optical elements.

9. The method of claim 1, wherein the 2D optical array comprises a grid of intersecting linear segments of light.

10. The method of claim 1, wherein the linear segments of light extend substantially along a longitudinal direction defined by aspect ratios in a range between 15:1 and 2:1.

11. The method of claim 1, wherein the linear segments of light are described by a Gaussian intensity profile along at least one transverse direction.

12. A system for controlling atomic particles using projected light, the system comprising:

a particle system including a plurality of atomic particles;

one or more optical sources configured to generate light fields using frequencies shifted from at least one atomic resonance; and a plurality of optical elements configured to form, using the generated light fields, a two-dimensional ("2D") optical array projected on the plurality of atomic particles, wherein the projected 2D optical array comprises linear segments of light that define locations for the plurality of atomic particles in space.

13. The system of claim 12, wherein the particle system is configured to cool the plurality of atomic particles to temperatures in a range between 1 and 100 micro Kelvin.

14. The system of claim 12, wherein the one or more sources are further configured to generate light fields using frequencies configured to achieve a blue detuning or a red detuning.

15. The system of claim 12, wherein the frequencies include at least a first and a second frequency.

16. The system of claim 15, wherein the at least first and second frequency are separated by a frequency separation configured to achieve a target coherence.

17. The system of claim 16, wherein the detuning is in a range between 10 and 100 nanometers.

18. The system of claim 12, wherein the plurality of optical elements are further configured to polarize the light fields in one or more directions.

19. The system of claim 12, wherein the plurality of optical elements are further configured to control a periodicity of the 2D optical array by modifying a magnification of the plurality of optical elements.

20. The system of claim 12, wherein the 2D optical array comprises a grid of intersecting linear segments of light.

21. The system of claim 12, wherein the linear segments of light extend substantially along a longitudinal direction defined by aspect ratios in a range between 15:1 and 2:1.

22. The system of claim 12, wherein the linear segments of light are described by a Gaussian intensity profile along at least one transverse direction.

* * * * *